United States Patent [19]

Nylander et al.

[11] Patent Number: 4,753,550

[45] Date of Patent: Jun. 28, 1988

[54] APPARATUS FOR CONTROL OF A LIQUID LEVEL, ESPECIALLY WATER LEVEL

[76] Inventors: Erik Nylander, Hagvägen 15, S-79143 Falun/Schweden; Sven-Erik Nylander, Trossvägen 10, S-82600 Söderhamn/Schweden, both of Sweden

[21] Appl. No.: 918,558

[22] Filed: Oct. 14, 1986

[51] Int. Cl.[4] ..... E02B 7/40

[52] U.S. Cl. ..... 405/94; 405/101

[58] Field of Search ..... 405/87, 94, 101, 92, 405/95, 99, 100, 102

[56] References Cited

U.S. PATENT DOCUMENTS

| | | | |
|---|---|---|---|
| 1,443,072 | 1/1923 | Frye | 405/101 X |
| 2,026,656 | 1/1936 | Schon | 405/101 X |
| 2,051,359 | 8/1936 | Adams | 405/101 |
| 2,118,404 | 5/1938 | Jermar . | |
| 4,073,147 | 2/1978 | Nomura | 405/94 |
| 4,455,106 | 6/1984 | Johnson | 405/94 |

FOREIGN PATENT DOCUMENTS

| | | |
|---|---|---|
| 1217143 | 5/1902 | France . |
| 195258 | 1/1938 | Switzerland . |

*Primary Examiner*—David H. Corbin

*Attorney, Agent, or Firm*—Burgess, Ryan & Wayne

[57] ABSTRACT

An apparatus for control of a liquid level, especially water level, comprising a partition (10) arranged in a drain channel (24) and having an upper edge (12) which serves as overflow. At its lower or bottom edge (14) opposite the upper overflow edge (12) the partition (10) is supported for swinging (axis of rotation 16) at the bottom of the drain channel (24). Extending obliquely upwardly from the bottom of the drain channel (24), away from the water end (18), the partition (10) is held by a level control means (20).

9 Claims, 2 Drawing Sheets

APPARATUS FOR CONTROL OF A LIQUID LEVEL, ESPECIALLY WATER LEVEL

FIELD OF THE INVENTION

The instant invention relates to an apparatus for control of a liquid level, especially water level, comprising at least one partition arranged to be raised or lowered in an outflow aperture or drain channel and having an upper edge which serves as an overflow.

BACKGROUND OF THE INVENTION

Apparatus of this kind are known in general and are called liquid or water dams or weirs. The partition or dam wall is raised and lowered in response to a water level gauge, such as a pressure gauge. The gauge controls a drive means which is operatively connected to the partition or dam wall so as to raise or lower the same accordingly thus permitting excess water to flow off over the upper edge of the partition or dam wall.

This type of control of the water level is rather expensive both in structure and control and thus susceptible of trouble.

SUMMARY OF THE INVENITON

Starting from the prior art explained above, it is an object of the instant invention to provide an apparatus of the kind specified initially which requires a minimum of structural expenditure. It is another object of the invention to provide an apparatus of the generic kind mentioned which will function properly and have a minor incidence of trouble.

These and other objects which will become apparent as the description proceeds are met in a surprisingly simple manner by the fact that the partition is supported for swinging about an axis of rotation at the bottom of the drain channel from which it extends obliquely upwardly, away from the water end, being held by a level control means.

The arrangement of the partition at an inclination in an upward direction away from the water end permits direct control of the water level, contrary to the known indirect control. The "water column resting" on the partition acts directly on the level control means associated with the partition. For this reason, a minimum of structural expenditure is possible while the susceptibility of trouble is low and the apparatus will function properly.

Structural details of the invention are recited hereinafter. The level control means has proved to be an especially simple and yet effective design. The simplest embodiment requiring the least amount of space is a level control means including a helical spring assembly. This assembly, furthermore, is adjustable rather well and accurately as to resiliency. As the spring excursion may be given any desired length, excellent fine adjustment is possible of the level control means. It is likewise conceivable to influence the spring characteristic by the effect of springs arranged in parallel such that the increasing opening of the partition will cause the spring resistance to rise or drop overproportionally, depending on the type of opening characteristic desired.

The apparatus according to the invention is suitable not only for integration in dams and barrages but also for smaller irrigation plants and even laboratory equipment in other words, wherever a certain elevation of a liquid or water is to be maintained by self-control.

The outflow plate recited is especially significant. On the one hand, it helps provide substantially a laminar flow-off of overflowing water and, on the other hand, at the end remote from the water of the partition, the arangement practically remains dry. The overflowing water does not rush like a waterfall over the upper edge of the partition. This has the further effect that no soil erosion takes place below or downstream of the partition.

BRIEF DESCRIPTION OF THE DRAWING

The invention will be described further, by way of example, with reference to the accompanying drawings, in which:

FIG. 5 is a sectional view, at an enlarged scale, of a detail of the partition according to FIG. 1.

DESCRIPTION OF THE PREFERRED EMBODIMENT

Figure 1:
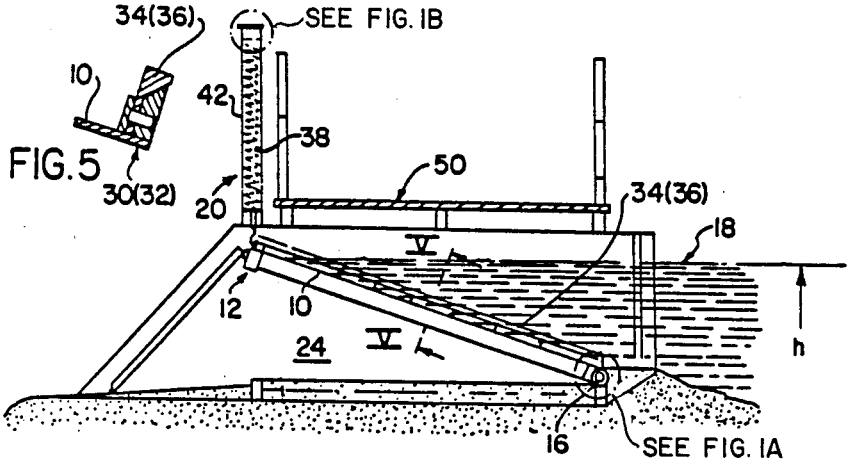
FIG. 1 is a diagrammatic side elevation of an apparatus according to the invention, the front sidewall, when looking at FIG. 1, being omitted of the drain channel in which the apparatus according to the invention is disposed.
Figure 1A:
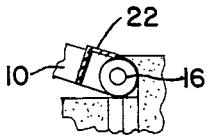
FIG. 1A is a partial cross-sectional view of the covering of the area of the hinge region for the partition.

The water dam shown diagrammatically in FIGS. 1 to 4 is designed as an apparatus for control of the elevation of water "h" in a reservoir or the like. The apparatus comprises a partition 10 arranged for swinging movement in a drain channel 24, the upper edge of the partition serving as an overflow. At its edge opposite the upper overflow edge 12, namely bottom edge 14, the partition 10 is hinged at the bottom or base of the drain channel 24, an axis of rotation 16 being formed which extends parallel to the edge 14. Starting from this axis of rotation 16, partition 10 is inclined in an upward direction away from the water end 18 and is held by a level control means 20. The bottom axis of rotation 16 is covered in a fluid-tight manner by a flexible covering strip 22 made, for instance, of plastics or rubber. Water thus cannot escape to the outside through the hinge region or area of the axis of rotation. The covering of the area of the axis of rotation is illustrated on an enlarged scale in FIG. 1A.

Opposite the upright sidewalls 26,28 of the drain channel 24, the partition 10 is sealed by sealing strips 34,36 positioned at the lateral edges 30,32 thereof. Reference is made to FIG. 5 in this context. The sealing strips 34,36 are arranged and designed such that they form a sealing bead which projects slightly beyond the lateral edge 30 and 32, respectively. The sealing strips preferably are made of plastics or rubber, especially wear-resistant hard rubber. If two or more partitions 10 are disposed one beside the other, the adjacent lateral edges preferably are interconnected by sealing sheets made of an elastically yielding material. In this manner water is prevented from flowing out between adjacent partitions if they are opened to different degrees due to different adjustment of the respective level control means associated with them.

Figure 1B:
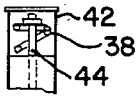
FIG. 1B is a side elevation view of the upper end of the level control means.

The upper overflow edge 12 of the partition 10 is linked to the level control means 20 mentioned supra. In this manner, the opening resistance is determined of the partition 10. In the case of the embodiment shown the level control means comprises a helical compression spring 38 through which extends a tension bar fixed at its one end to the overflow edge 12 of the partition 10, while its other end is connected to the upper end of the compression spring 38, as may be gathered from the detail presentation in FIG. 1B. As will be seen, a weatherproof arrangement is provided in the range of the upper overflow edge 12 for the compression spring 38 which is housed in a covering sleeve 42 above the drain channel 24. The tension bar extending through the helical compression spring 38 is marked 44 in detail presentation II.

Figure 2:
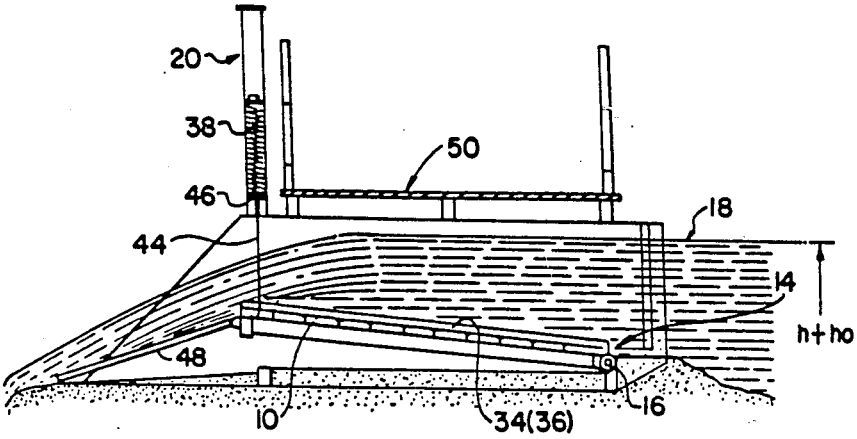
FIG. 2 is a presentation of the apparatus shown in FIG. 1 with the partition being opened.
Figure 3:
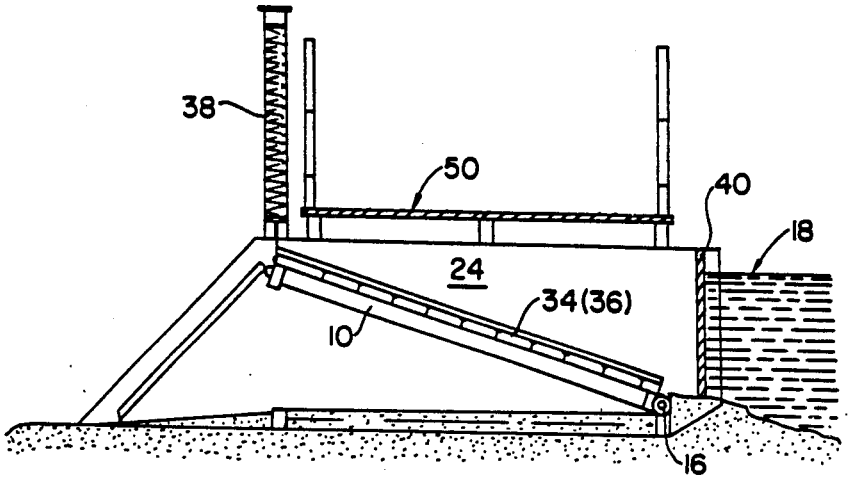
FIG. 3 is a presentation of the apparatus shown in FIG. 1 with the drain passage being blocked by an upright bulkhead.
Figure 4:
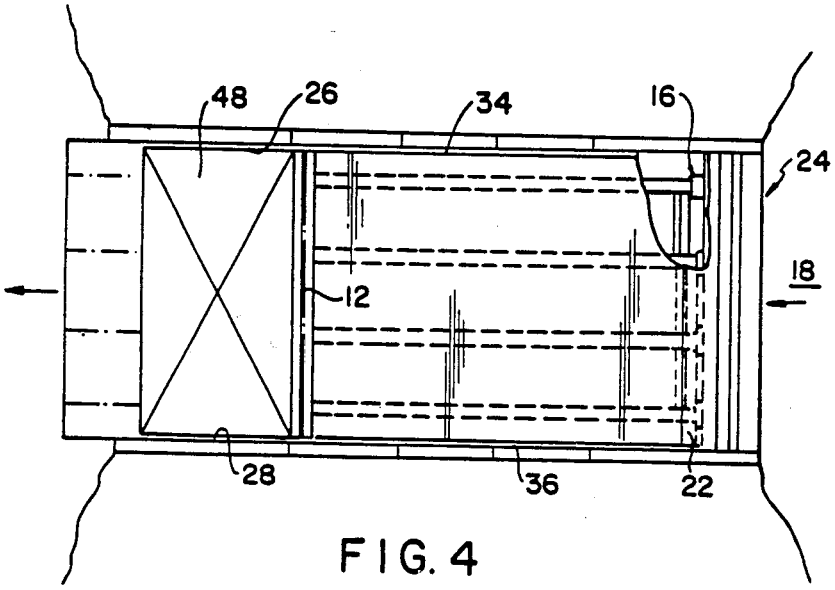
FIG. 4 is a top plan view of the apparatus shown in FIG. 1.

As shown in FIG. 2, the tilting of the partition 10 and thus the opening of the drain channel 24 when a given water level "$h+h_o$" is reached, can be selected by corresponding adjustment of the resiliency of the spring or choice of the type of compression spring 38.

The helical compression spring 38 is supported within the sleeve 42 or spring casing by a lower closing ring 46 through which the tension bar 44 extends as well. This type of level control means provides particularly easy access and is easy to service and adjust. Furthermore, it can be kept dry easily because it is disposed above the maximum level of the water to be controlled.

An outflow plate 48 is pivoted at the upper overflow edge 12 of the partition 10 in order to prevent water from rushing like a waterfall over the edge 12, thereby causing soil erosion. The bottom of the flow plate 48 which is remote from the overflow edge 12 lies loosely on the bottom of the drain channel 24. This means that it can slide back and forth on the bottom. In this manner, it is no problem for the outflow plate 48 to follow the swinging movement of the partition 10. The outflow plate 48 also prevents water from getting to the axis of rotation 16 which, therefore, largely can be kept dry.

With the embodiment shown, furthermore a passage is provided extending across the drain channel 24, such as a bridge 50 to be walked and/or driven across. The level control means 20 is readily accessible from this bridge 50 and may be serviced from the bridge. The drain channel, partition, level control means, and bridge preferably are provided as a self-contained structural unit adapted for integration into the surroundings at a suitable place.

During maintenance and service of the apparatus described, the partition 10 preferably is kept free of water. To this end, the drain channel 24 is blocked by an upright bulkhead 40. In this respect, it is a known weir structure (cf. FIG. 3).

However, it proved to be advantageous to provide a permanent bulkhead 40 in the drain channel 24, with the upper edge of this bulkhead always located below the level of the water elevation to be controlled. In this manner, any dirt and gravel or sand carried along by the water will accumulate upstream of the bulkhead, the partition 10 and especially its sealing strips thus being kept free of such material. Any deposits formed downstream of such bulkhead can be removed from time to time.

What is claimed is:

1. An apparatus for control of a liquid level in a drain channel, said apparatus comprising:

a partition arranged to be raised and lowered in the drain channel, the partition having an upper edge which serves as an overflow for the liquid in the drain channel and a lower edge pivotally supported along an axis of rotation extending approximately parallel to the lower edge of the partition, and the partition extendign obliquely upward from the lower edge away from the liquid in the drain channel; and level control means for holding the partition in the obliquely extended position, said level control means including spring assembly means being located above and joined to the partition at a general area of the upper edge thereof for determining an opening resistance of the partition such that said partition pivots downwardly about said axis when the liquid level reaches a predetermined level dependence on said spring assembly means.

2. An apparatus according to claim 1; further including flexible covering strip means for covering an area about the lower edge of the partition in a fluid-tight manner.

3. Apparatus according to claim 1, wherein said partition is arranged as an obstacle for water within the drain channel and the drain channel has upright side walls; and further comprising sealing strip means arranged at lateral edges of the drain channel for sealing said partition adjacent said upright wall.

4. Apparatus according to claim 1; wherein said spring assembly means includes a helical spring.

5. Apparatus according to claim 1; wherein said spring assembly means includes a spring that is adjustable in resilience and therefore variable as to an opening resistance for said partition.

6. Apparatus accordign to claim 5, wherein the resilience of the spring assembly means is adjusted so that, upon the liquid level in the drain channel reaching an elevation ($h=h_o$), the partition pivots downwardly about said axis of rotation within the drain channel so that excess water within the drain channel overflows the upper overflow edge of the partition and, upon outflow of an amount so as to lower the water level to a predetermined limit height (h), the partition pivots back upwardly into an obstructing position.

7. Apparatus according to claim 1; further comprising a bulk head of variable height positioned in the drain channel upstream of the partition, as seen from the water end of the drain channel, for blocking the drain channel.

8. Apparatus according to claim 1; further conmprising an outflow plate pivoted at the upper overflow edge of the partition and supported slidably at the bottom of the drain channel, the outflow plate having a width correspondign approximately to the width of the drain channel.

9. Apparatus according to claim 1; wherein the drain channel with the partition and level control means is designed as a self-contained structural unit, which further comprises a passage leading across the drain channel with the level control means disposed above the partition and being accessible from said passage.

* * * * *